US007568878B2

(12) United States Patent
Frey

(10) Patent No.: US 7,568,878 B2
(45) Date of Patent: Aug. 4, 2009

(54) LOADER BOOM ARM

(75) Inventor: Oscar Frey, Listowel (CA)

(73) Assignee: Frey Industries Limited, Listowel, Ontario (CA)

( * ) Notice: Subject to any disclaimer, the term of this patent is extended or adjusted under 35 U.S.C. 154(b) by 343 days.

(21) Appl. No.: 11/400,176

(22) Filed: Apr. 10, 2006

(65) Prior Publication Data

US 2007/0031233 A1 Feb. 8, 2007

Related U.S. Application Data

(63) Continuation-in-part of application No. 11/186,887, filed on Jul. 22, 2005, now Pat. No. 7,354,237.

(51) Int. Cl.
*E02F 3/38* (2006.01)

(52) U.S. Cl. ..... 414/686; 414/917

(58) Field of Classification Search ..... 414/686, 414/700–715, 722, 917
See application file for complete search history.

(56) References Cited

U.S. PATENT DOCUMENTS

| | | | | |
|---|---|---|---|---|
| 3,722,724 | A | 3/1973 | Blankley | |
| 3,952,890 | A * | 4/1976 | Armstrong | 414/694 |
| 4,264,264 | A | 4/1981 | McMillan et al. | |
| 4,798,511 | A | 1/1989 | Kaczmarczyk et al. | |

(Continued)

FOREIGN PATENT DOCUMENTS

| | | | |
|---|---|---|---|
| GB | 2126982 | A | 4/1984 |

(Continued)

OTHER PUBLICATIONS

PCT International Search Report, PCT/CA2006/000712, pp. 1-3.

(Continued)

*Primary Examiner*—Donald Underwood
(74) *Attorney, Agent, or Firm*—Bereskin & Parr LLP

(57) ABSTRACT

A loader boom arm for a material handling vehicle used in the agricultural or construction industries includes a post attachable to the vehicle, a lower arm pivotally connected to the post, an upper arm pivotally connected to the lower arm, a pivoting mechanism coupled to the post and the lower arm, and a link arm pivotally connected to the post and to the upper arm. The boom arm is raised and lowered in an angular direction of rotation by pivoting the lower arm about the post using the pivoting mechanism. As the lower arm is pivoted, the link arm causes the upper arm to pivot relative to the lower arm such that the upper arm pivots further in the direction of angular rotation than the lower arm, thus changing the angle between the lower arm and upper arm. The boom arm also preferably includes a low profile self leveling linkage assembly for maintaining the levelness of a bucket during raising and lowering of the boom arm, having a control arm pivotally connected to the lower arm, a rotator link pivotally connected to the upper arm at a leveling fulcrum, and an output arm pivotally connected to the rotator link and pivotally connectable to a work implement. The subject loader boom arm allows an operator to move material in a bucket attached to the boom arm to locations of higher elevation and further reach than typically available with conventional boom arms.

13 Claims, 14 Drawing Sheets

U.S. PATENT DOCUMENTS

| | | | | |
|---|---|---|---|---|
| 4,825,568 | A | 5/1989 | Kawamura et al. | |
| 5,152,659 | A | 10/1992 | Waka | |
| 5,261,780 | A | 11/1993 | Perry | |
| 5,405,237 | A | 4/1995 | Oka | |
| 5,590,480 | A | 1/1997 | Peterson et al. | |
| 6,171,050 | B1 | 1/2001 | Johnson | |
| 6,325,589 | B1 | 12/2001 | Jang et al. | |
| 6,409,459 | B1 | 6/2002 | Ginn et al. | |
| 6,776,571 | B2 | 8/2004 | Riffle | |
| 7,354,237 | B2 * | 4/2008 | Frey | 414/686 |
| 2004/0042888 | A1 | 3/2004 | Westendorf et al. | |

FOREIGN PATENT DOCUMENTS

| | | | |
|---|---|---|---|
| GB | 2134070 | A | 8/1984 |
| JP | 60-199124 | A | 8/1985 |
| WO | WO 2004/0035944 | A1 * | 4/2004 |

OTHER PUBLICATIONS

Written Opinion, PCT/CA2006/000712, pp. 1-5.

* cited by examiner

LOADER BOOM ARM

RELATED APPLICATION

This application is a continuation-in-part of application Ser. No. 11/186,887 filed on 22 Jul, 2005, now U.S. Pat. No. 7,354,237.

FIELD OF THE INVENTION

The present invention relates to loader boom arms for material handling vehicles, and in particular, to loader boom arms for tractors and other small vehicles used in the agricultural and construction industries.

BACKGROUND OF THE INVENTION

Material handling vehicles with boom arms and buckets are used in the construction and agricultural industries to move material such as earth. An operator will use the boom arm to raise the bucket off the ground so that the material can be placed in a dump truck or other location. Often the desired location is at a substantial height above ground and a considerable distance in front of the loader.

Conventional loaders for tractors typically comprise a two-piece boom arm having a lower arm pivotally connected to the frame of the tractor and an upper arm rigidly connected to the lower arm at a fixed angle that provides clearance for the front wheels of the tractor. However, the use of a fixed angle boom arm limits the maximum height elevation and forward extension of the boom arm. This limitation restricts where an operator can place material using the bucket, making some remote locations inaccessible to the operator.

Conventional loaders can be sized to provide extra height and forward extension. However, the boom arms for these loaders tend to be significantly larger, more cumbersome, and more expensive than the boom arms for traditional small loaders for tractors.

Other prior art loaders, such as large excavators, have a two-piece boom arm comprising a lower arm pivotally attached to the vehicle, and an upper arm pivotally attached to the lower arm. The lower arm is raised and lowered by extension and retraction of a hydraulic cylinder connected between the vehicle and lower arm. The upper arm is rotated by the extension and retraction of a second hydraulic cylinder connected between the lower arm and the upper arm. A third hydraulic cylinder, connected between the upper arm and bucket, controls the tilt of the bucket. When the boom arm is in the lowered position, the operator can set the angle between the lower and upper arm to ensure that wheel clearance is maintained. In the raised position, the operator can rotate the upper arm so that it is parallel with the lower arm, providing additional bucket elevation and forward reach.

The major drawback of this type of loader boom arm is that the lower and upper arms must be controlled independently using two different controls. Simultaneous movement of both arms is further complicated by having the upper arm rotating relative to the motion of the lower arm. In addition to the dual boom arm operation, the operator must also control the tilt of the bucket, which moves in relation to the both the lower arm and the upper arm. The added complication of operating all three device independently means that more experienced and highly trained workers are required to operate large excavators. Even then, very few operators can master the precise art of moving the three devices simultaneously.

Another problem with conventional loaders is the design of self leveling linkage assemblies that maintain a level bucket during raising and lowering of a boom arm. Conventional self leveling linkages have a rod that is offset above the main boom arm. Due to its high profile, the rod may obstruct an operator's view, preventing accurate use of the boom arm and bucket. Furthermore, since the rod extends along the entire length of the boom arm, it requires a substantial amount of material, which is undesirable from a manufacturing and cost perspective.

Accordingly, there is a need for a loader boom arm that can provide additional elevation and/or forward extension of a bucket without increasing the difficulty level associated with operating the boom arm. There is also a need for a loader boom arm having a self leveling linkage that does not obstruct the view of an operator.

SUMMARY OF THE INVENTION

The present invention is directed to a boom arm for operating a work implement from a vehicle. The boom arm comprises a post rigidly attachable to the vehicle, a lower arm pivotally connected to the post at a first pivot point, a pivoting mechanism for pivoting the lower arm about the first pivot point in an angular direction of rotation, an upper arm pivotally connected to the lower arm at a second pivot point, the upper arm having a free end shaped for receiving a work implement, and a link arm pivotally connected to the post and the upper arm. The link arm is configured and located for pivoting the upper arm about the second pivot point in the angular direction of rotation as the lower arm is pivoted about the first pivot point by the pivoting mechanism.

The upper arm functions as a lever having a fulcrum at the second pivot point, wherein the lever comprises a lever arm portion and a resistance arm portion, the lever arm portion being pivotally coupled to the link arm. In a preferred embodiment, the lever arm portion extends backwardly towards the lower arm from the second pivot point, and the resistance arm extends forwardly from the second pivot point to the free end of the upper arm, and the link arm pulls downwardly on the lever arm portion of the upper arm as the lower arm is raised, thereby causing the resistance arm portion of the upper arm to pivot upwardly relative to the lower arm.

The lower arm extends along a lower arm axis, and the upper arm extends along an upper arm axis, the upper arm axis being oriented at an angle to the lower arm axis, wherein the angle changes as the lower arm is pivoted by the pivoting mechanism. The link arm may comprise a first end portion pivotally connected to the post at a third pivot point positioned below the upper arm axis, and a second end portion pivotally connected to the upper arm at a fourth pivot point positioned above the upper arm axis. In the lowered position, the lower arm and the upper arm form an angle to provide a wheel clearance between the lower arm and a front wheel on the vehicle. In the fully raised position, the lower arm and the upper arm are substantially co-linear. The pivoting mechanism preferably comprises a linear actuator such as a hydraulic cylinder extending from the post to a point near the distal end of the lower arm.

The present invention is also directed to a boom arm for operating a work implement from a vehicle. The boom arm comprises a post rigidly attachable to the vehicle, a lower arm extending along a lower arm axis, the lower arm having a proximal end and a distal end, the proximal end being pivotally connected to the post at a first pivot point, a pivoting mechanism for pivoting the lower arm about the lower pivot point in an angular direction of rotation, an upper arm extending along an upper arm axis, the upper axis being oriented at an angle to the lower axis, the upper arm having a proximal end pivotally connected to the distal end of the lower arm at a second pivot point, and a distal end shaped for receiving a work implement, and a link arm pivotally connected to the post and the upper arm. The link arm is configured and located for rotating the upper arm about the second pivot point as the lower arm is pivoted by the pivoting mechanism, such that the upper arm is rotated further in the angular direction of rotation than the lower arm.

The present invention is also directed to a self leveling linkage assembly for maintaining the levelness of the work implement during raising and lowering of the boom arm, the self leveling linkage assembly comprising a control arm pivotally connected to the lower arm, a rotator link pivotally connected to the control arm and pivotally connected to the upper arm at a leveling fulcrum, and an output arm pivotally connected to the rotator link and pivotally connectable to the work implement.

BRIEF DESCRIPTION OF THE DRAWINGS

The invention will now be described, by way of example only, with reference to the following drawings, in which.

DETAILED DESCRIPTION OF THE INVENTION

Figure 1:
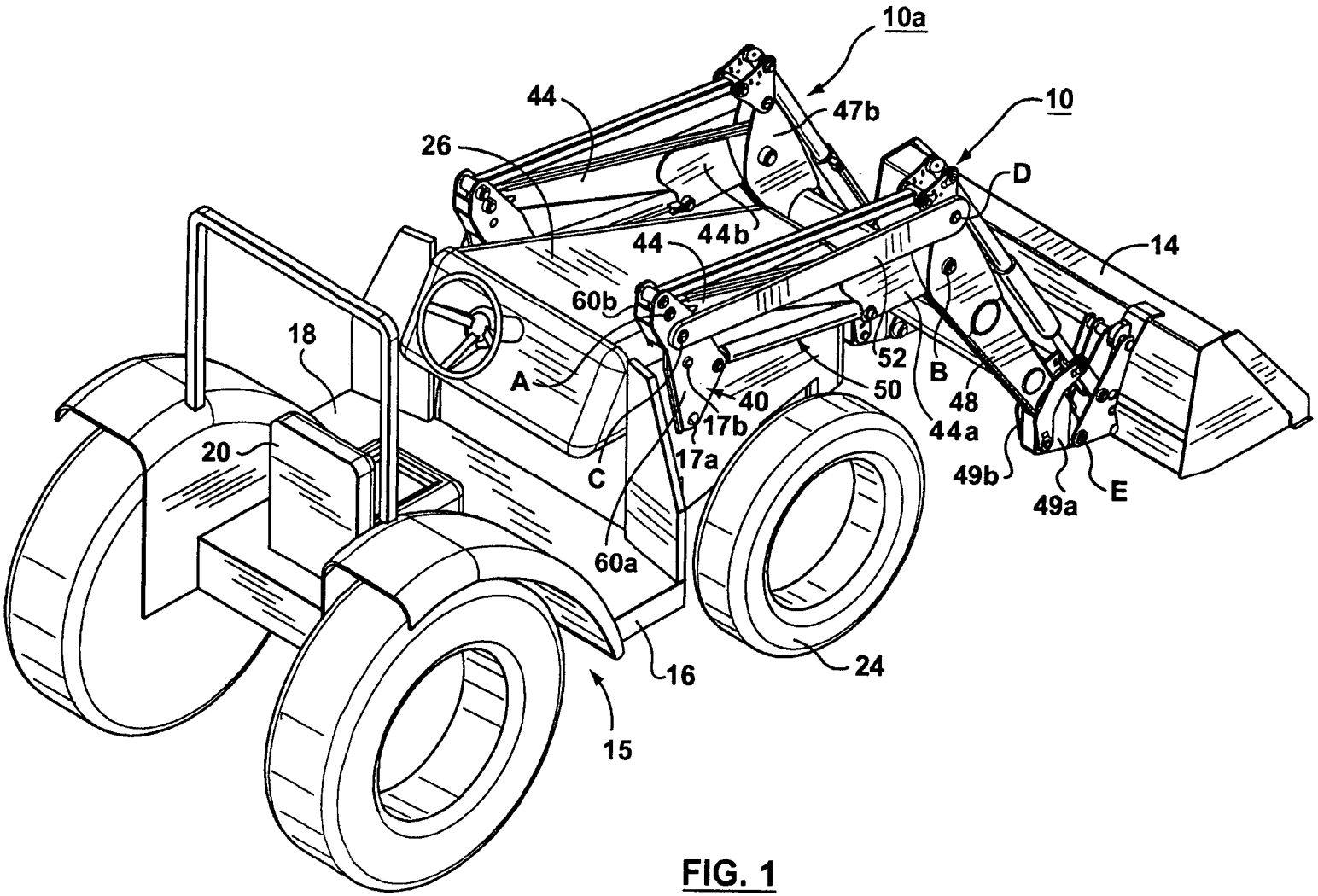
FIG. 1 is an elevated rear perspective view of a pair of loader boom arms made in accordance with a preferred embodiment of the present invention, shown mounted on a tractor and attached to a bucket.

Referring to FIG. 1, illustrated therein is a pair of loader boom arms 10, 10*a* made in accordance with the subject invention, shown connected to a bucket 14 and mounted on a tractor 15 having a frame 16, driver's compartment 18 with seat 20, front tires 24 and engine compartment 26. Boom arms 10 and 10*a* are attached to frame 16 on laterally disposed sides of engine compartment 26. Bucket 14 is pivotally attached to the free ends of boom arms 10 and 10*a* at pivot point E. Orientation of boom arms 10 and 10*a* is such that bucket 14 extends forward from the front face of the tractor 15 so as to allow operation of the bucket 14 on material that is located in front of tractor 15. In operation, an operator sitting in seat 20 can drive tractor 15, move boom arms 10 and 10*a* and control bucket 14.

Boom arm 10*a* is a mirror image of boom arm 10, and unless otherwise stated, the components of boom arm 10*a* are the same as the components of boom arm 10. Boom arms 10, 10*a* operate in conjunction with each other to provide the continuous and symmetrical movement of bucket 14. Boom arms 10 and 10*a* and their component parts are preferably fabricated from steel or similar metal to provide strength and manufacturability.

In accordance with a preferred embodiment of the subject invention, boom arm 10 comprises an upwardly extending post 40 rigidly attachable to frame 16 of tractor 15, a lower arm 44 pivotally connected to post 40 at first pivot point A, an upper arm 48 pivotally connected to lower arm 44 at second pivot point B, pivoting mechanism 50 coupled to post 40 and lower arm 44 for pivoting lower arm 44 about first pivot point A, and link arm 52 pivotally connected to post 40 at third pivot point C and to upper arm 48 at fourth pivot point D.

Post 40 is rigidly attached to frame 16 of tractor 15 by mounting pins 17*a*, 17*b*, or alternatively by other attachment means such as welds, bolts, rivets or sockets. Post 40 consists of two flat metal plates, 60*a* and 60*b*, separated by spacers that are affixed thereto. The spacers provide an opening for attachment of post 40 to frame 16 and provide an opening for attachment of linkage members. Metal plates 60*a* and 60*b* are selected in shape and material to have suitable strength for supporting boom arm 10, bucket 14, and a load carried by the bucket.

Figure 2:
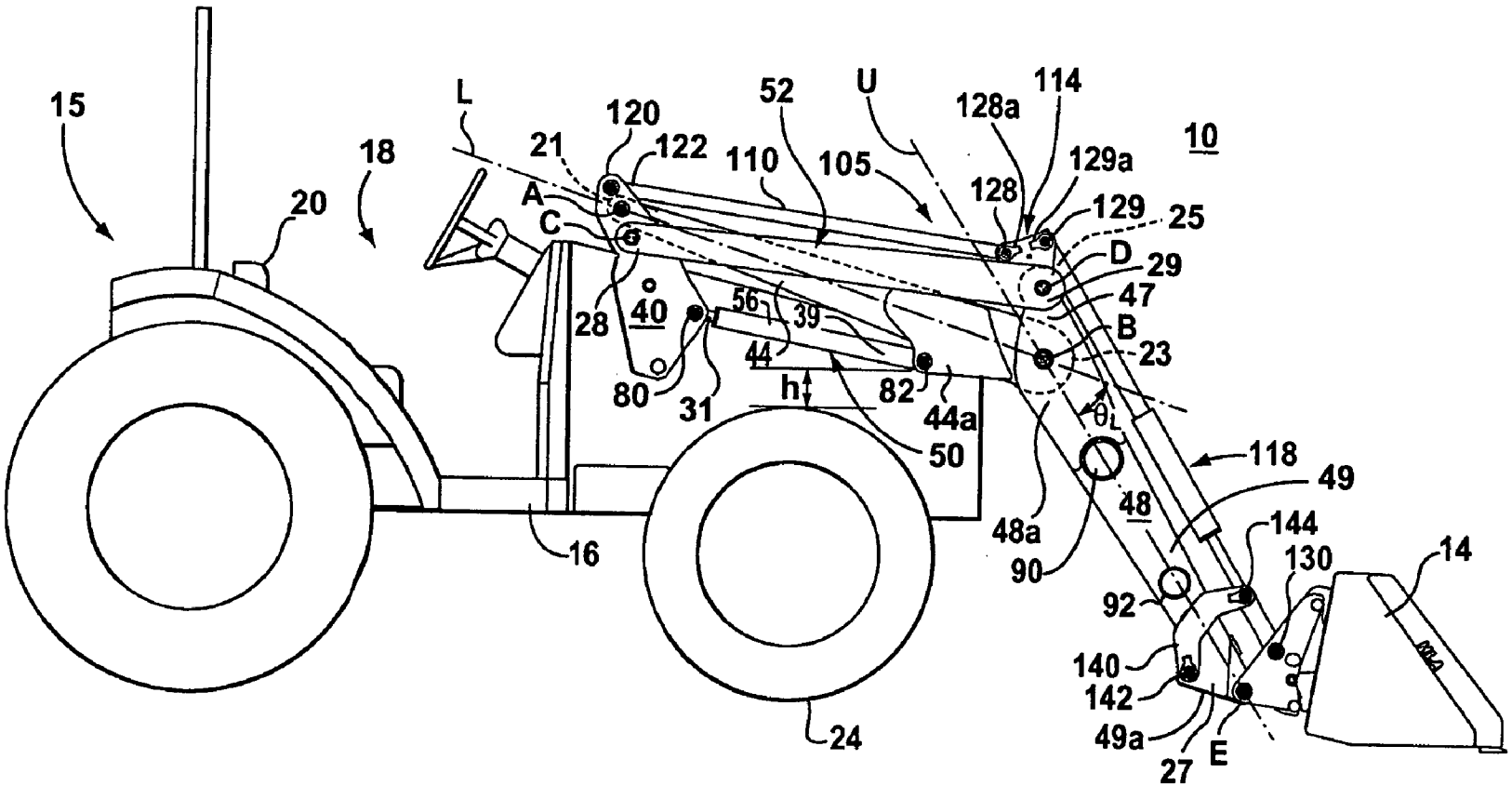
FIG. 2 is a side elevational view of the subject boom arm, shown mounted on a tractor and positioned in a lowered position.
Figure 3:
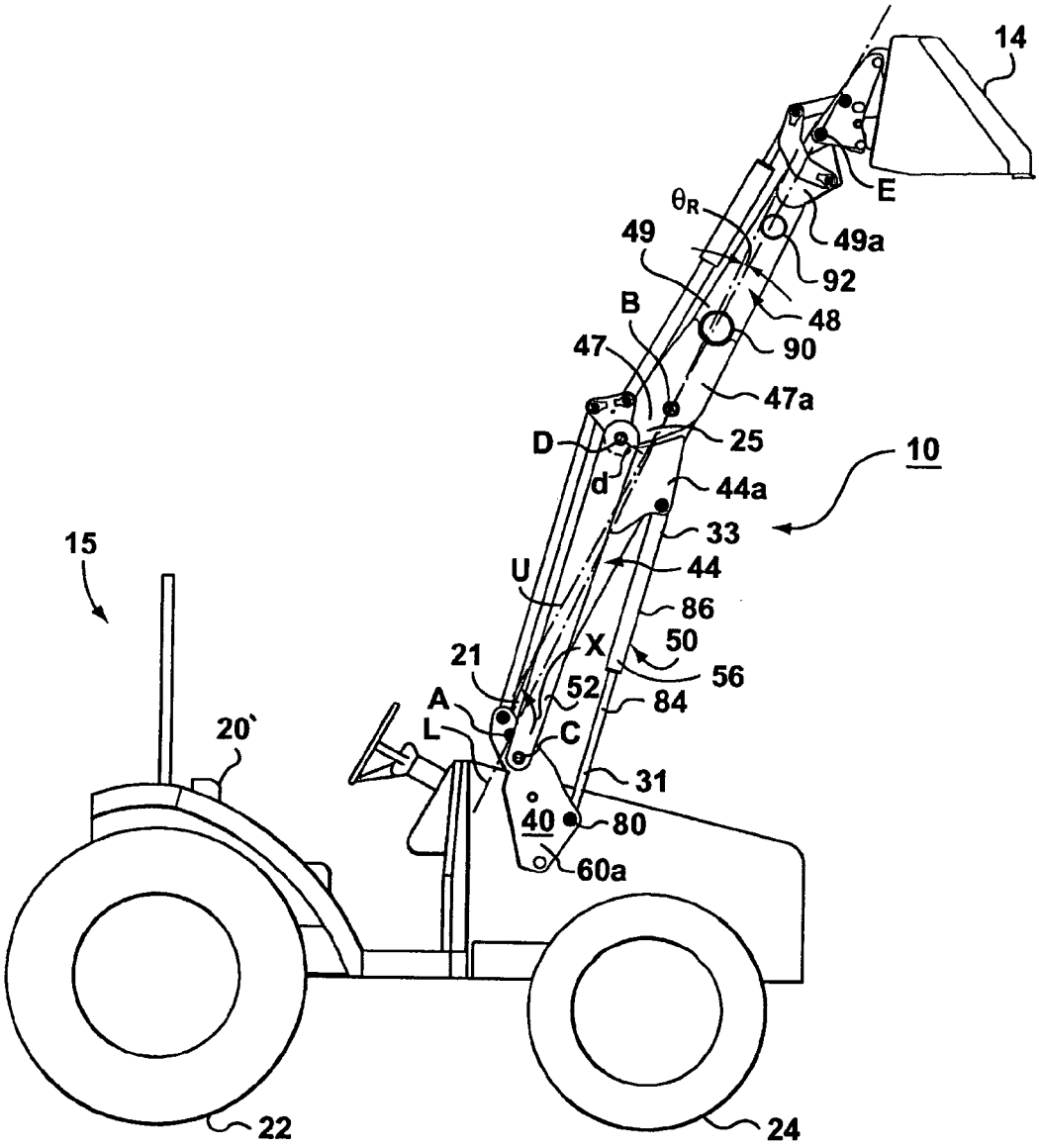
FIG. 3 is a side elevational view of the subject boom arm, shown mounted on a tractor and positioned in a raised position.

Referring now to FIGS. 1, 2 and 3, lower arm 44 has a proximal end 21 proximate to post 40 and a distal end 23 distant from post 40. Lower arm 44 is pivotally connected to post 40 at first pivot point A located near proximal end 21. Lower arm 44 extends along a lower arm axis L defined by pivot points A and B. Weldments in the form of pairs of spaced, parallel plates 44*a* and 44*b* are welded to the left and right hand sides of lower arm 44 near distal end 23 to provide a straddle mounted connection for pivoting mechanism 50.

Upper arm 48 is pivotally connected to lower arm 44 at second pivot point B. Upper arm 48 has a proximal end 25 proximate to lower arm 44 and a free end 27 distant from lower arm 44 shaped for pivotally attaching bucket 14 at fifth pivot point E. Upper arm 48 extends along on upper arm axis U defined by second pivot point B and fifth pivot point E. Upper arm axis U extends at a variable angle θ to lower arm axis L. As described in more detail hereinbelow, upper arm 48 functions as a lever having its fulcrum at second pivot point B. Second pivot point B divides upper arm 48 into two portions, a lever arm portion 47 extending backwardly from pivot point B to proximal end 25, which functions as the lever arm or effort arm of the lever, and a resistance arm portion 49 extending forwardly from pivot point B to free end 27, which functions as the resistance arm of the lever. Lever arm portion 47 comprises weldments in the form of a pair of spaced, parallel plates 47*a*, 47*b* having aligned apertures for attachment of link arm 52 at pivot point D. Resistance arm portion 49 comprises weldments in the form of a pair of spaced, parallel plates 49*a*, 49*b* having aligned apertures for pivotal attachment of bucket 14.

Both lower arm 44 and upper arm 48 are preferably fabricated as hollow members to provide a high strength to weight ratio, having weldments as aforesaid to provide connection points for various linkage members and to increase the overall strength of the boom arm. The hollow members can be formed by bending and welding together metal plates or channels.

Pivoting mechanism 50 is coupled to post 40 and lower arm 44 and is designed to alternately raise and lower arm 44 by pivoting lower arm 44 about first pivot point A. Pivoting mechanism 50 preferably comprises a linear actuator such as hydraulic cylinder 56 connected to a hydraulic system and operator control panel (not shown) to allow the operator to move the boom arm via one input means. The near end 31 of hydraulic cylinder 56 is connected to post 40 between plates 60*a* and 60*b* at a pin joint 80. The far end 33 of hydraulic cylinder 56 is connected to lower arm 44 between plates 44*a* and 44*b* at pin joint 82. Upon activation of hydraulic cylinder 56, the ram portion 84 of hydraulic cylinder 56 protrudes outward from the cylinder portion 86. The force applied to lower arm 44 rotates lower arm 44 upwardly in an angular direction of rotation X about first pivot point A. Alternatively, pivoting mechanism 50 could comprise other pivoting mechanisms such as, but not limited to, a motor and gear assembly that rotates lower arm 44 between the raised and lowered position.

Link arm 52 is a solid metal rod that links upper arm 48 to post 40. Link arm 52 comprises a first end portion 28 pivotally connected to post 40 at third pivot point C, and second end portion 29 pivotally connected to upper arm 48 at fourth pivot point D. Third pivot point C is located vertically below pivot point A and lower arm axis L. Fourth pivot point D is offset from upper boom axis U by a distance d and located vertically above lower boom axis L when lower arm 44 is in its lowered position. The locations of pivot points A and B and pivot points C and D set link arm 52 in a position whereby link arm 52 crosses lower arm 44 during raising and lowering of boom arm 10.

Link arm 52 is configured and connected in such a fashion to post 40 and upper arm 48 so as to pull down on lever arm portion 47 of upper arm 48 as lower arm 44 is raised by pivoting mechanism 50. This action causes resistance arm portion 49 of upper arm 48 to pivot upwardly about second pivot point B. Likewise, when lower arm 44 is lowered by pivoting mechanism 50, link arm 52 pushes up on lever arm portion 47 of upper arm 48, causing resistance arm portion 49 to pivot downwardly about pivot point B. Thus it can be seen that upper arm 48 acts as a class 1 lever having its fulcrum at pivot point B, with lever arm portion 47 being the lever arm or effort arm of the lever, and resistance arm portion 49 being the resistance arm of the lever. This lever action caused by link arm 52 results in upper arm 48 pivoting further in a given angular direction of rotation than lower arm 44, thereby changing angle θ between lower arm axis L and upper arm axis U as boom arm 10 is raised or lowered. In particular, angle θ is reduced as boom arm 10 is raised and angle θ is increased as boom arm 10 is lowered.

In FIG. 2, boom arm 10 is shown in its fully lowered position, being characterized by the retracted hydraulic cylinder 56. In its retracted position, the ram portion 84 fully encased in the cylinder portion 86. When boom arm 10 is in the lowered position, the specific linkage design provides a wheel clearance 'h' between the hydraulic cylinder 56 and the front wheel 24. The wheel clearance is obtained by forming an angle $\theta_L$ between the lower arm axis L and upper arm axis U. As shown, angle $\theta_L$ is approximately 39°.

In FIG. 3, boom arm 10 is shown in its fully raised position, wherein hydraulic cylinder 56 is extended and the ram portion 84 fully protrudes from the cylinder portion 86. In the fully raised position, the lower arm 44 and the upper arm 48 form a smaller angle $\theta_R$ and are substantially co-linear compared to when boom arm 10 is in its raised position. As shown, angle $\theta_R$ is approximately 3°.

Figure 4:
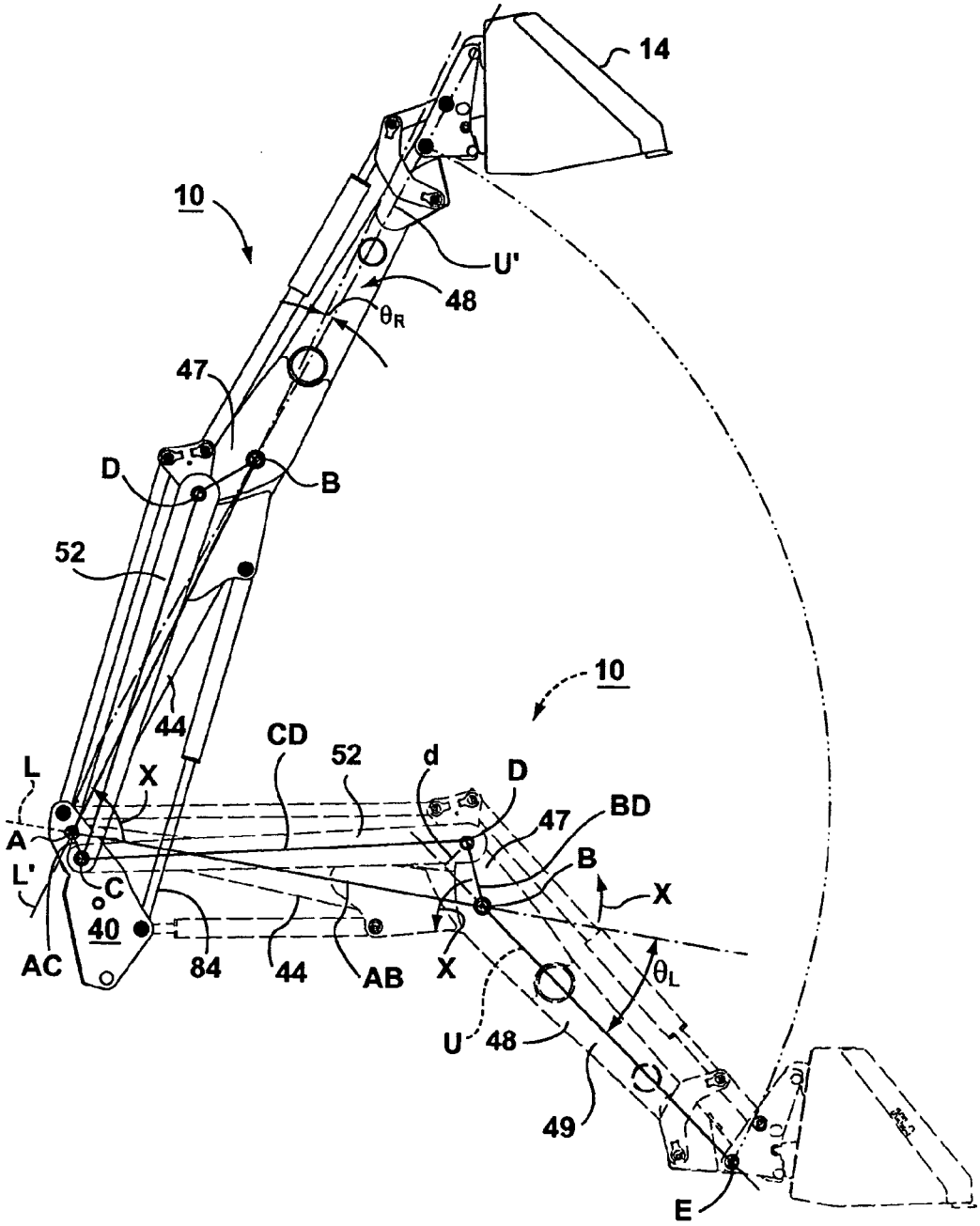
FIG. 4 is a side elevational view of the subject boom arm shown in solid lines in a raised position and shown in broken lines in a lowered position.

Referring now to FIG. 4, illustrated therein is boom arm 10 shown in broken lines in a lowered position and shown in solid lines in a raised position. The components of boom arm 10 are connected together in such a fashion that portions of post 40, lower arm 44, link arm 52, and upper arm 48 together form a four bar linkage. The lengths and connection points on these bars of this linkage are selected such that when lower arm 44 is pivoted, in a given angular direction of rotation, the linkage causes link arm 52 to either pull down or push up on lever portion 47 of upper arm 48, thereby causing upper arm 48 to rotate about pivot point B in the same angular direction of rotation as lower arm 44, such that upper arm 48 rotates further than lower arm 44 in the given angular direction of rotation.

As shown, the four bar linkage comprises post link AC, comprising the portion of post 40 extending between pivot points A and B, a lower arm link AB, comprising the portion of lower arm 44 extending between pivot points A and B, a link arm link CD, comprising the portion of link arm 52 extending between pivot points C and D, and an upper arm link BD, comprising lever arm portion 47 of upper arm 48 extending between pivot points B and D. The length of lower arm link AB is longer than the length of link arm link CD, and the length of upper arm link BD is longer than the length of post link AC. Moreover, the combined length of lower arm link AB and post link AC is greater than the combined length of link arm link CD and upper arm link BD. As such, the subject four bar linkage is a triple rocker, in which none of the links can make a full rotation around its pivot points.

Due to the geometry of the subject four bar linkage, when lower arm 44 is raised by actuation of hydraulic cylinder 56, lower arm link AB rotates upwardly in angular direction of rotation X about first pivot point A. At the same time, CD rotates about third pivot point C, and pulls down on upper arm link BD, which in turn causes resistance arm portion 49 of upper arm 48 to rotate upwardly about second pivot point B, with pivot point B acting as the fulcrum point of a lever. It can be seen, however, that both upper arm link BD and portion BE rotate in the same angular direction X as lower arm link AB. Accordingly, when lower arm 44 is raised or lowered by hydraulic cylinder 56, link arm 52 causes upper arm 48 to rotate further in the same angular direction of rotation as lower arm 44.

Figure 5:
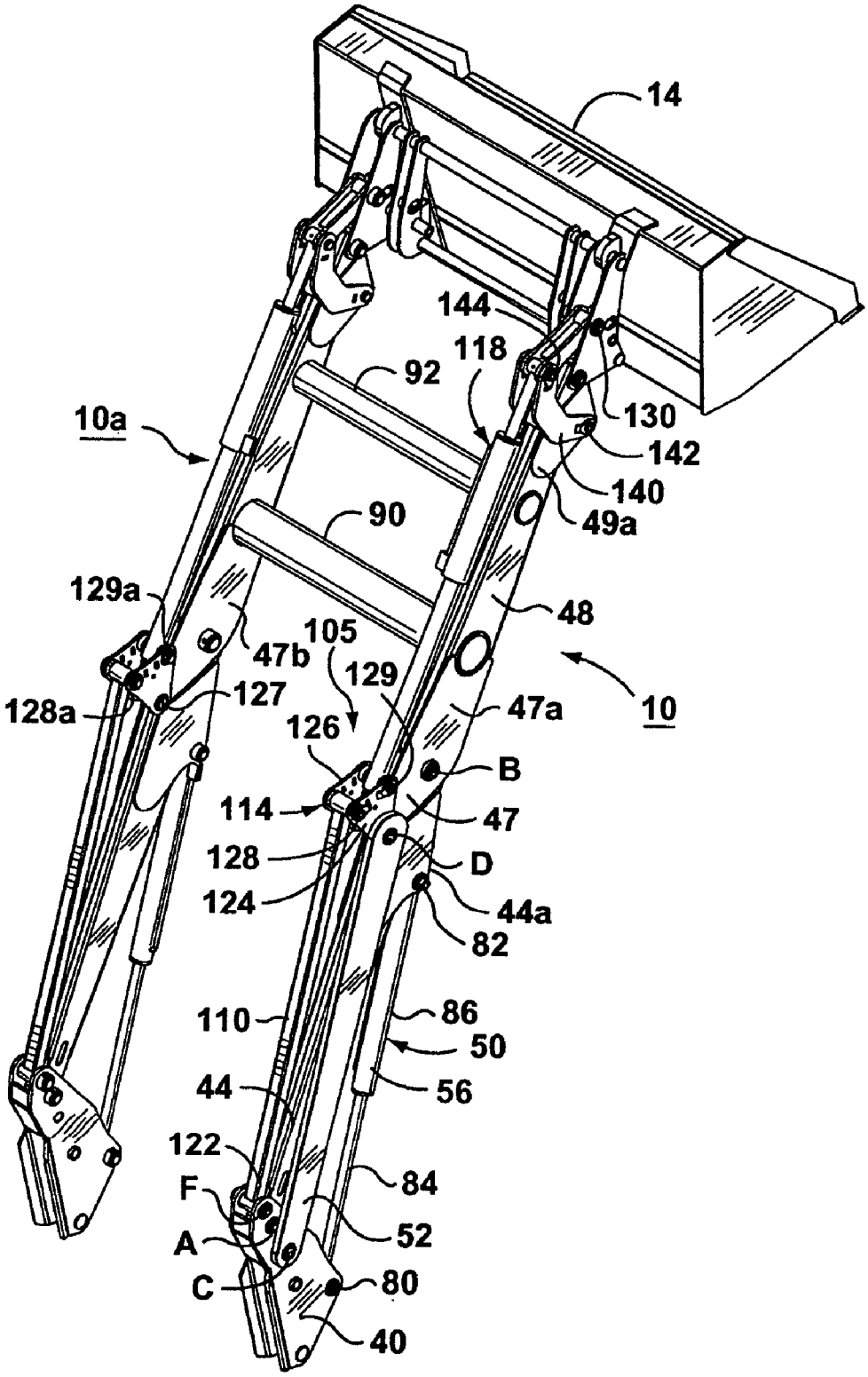
FIG. 5 is an elevated rear perspective view of a pair of boom arms shown in a raised position with a bucket coupled thereto.
Figure 6:
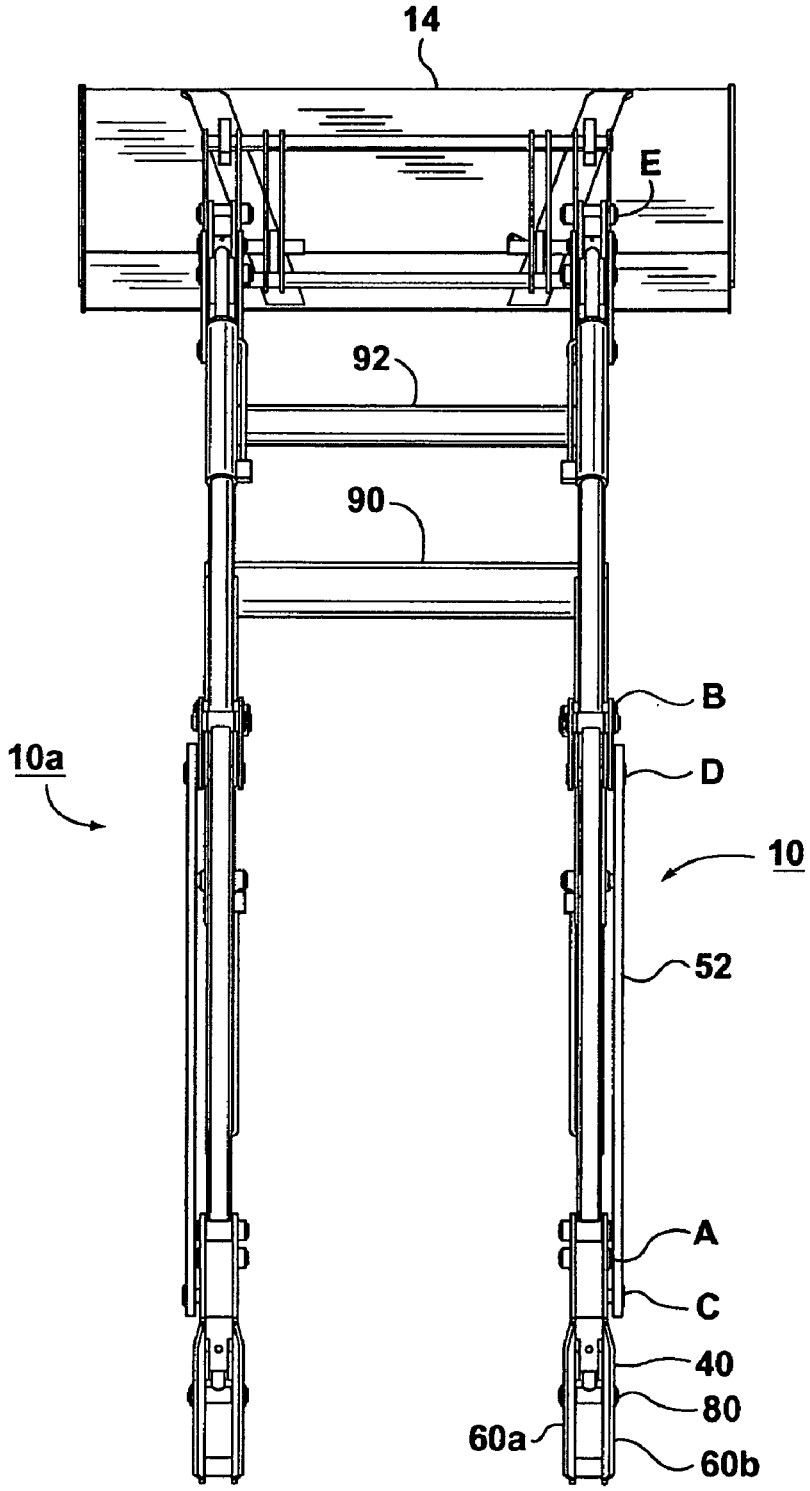
FIG. 6 is a rear elevational view of the boom arm shown in FIG. 5.

Referring now to FIGS. 5 and 6, first and second pivot points A, B and pin joints 80, 82 are preferably straddle mounted pin joints that position one member between two elongated forks of the receiving member. The straddle mounted pin joint is used to provide structural rigidity. These joints can be formed using a sleeve bearing or other suitable pin joint that allows rotation of the connecting members about the pivot point. In the preferred embodiment, the sleeve bearing has a reduced friction shaft that slides through a stationary sleeve and/or a drilled hole in the receiving members. The shaft has two ends with diameters larger than the main diameter of the shaft to prevent the sleeve bearing from falling out. If the shaft is lubricated, the two ends prevent lubricant from leaking.

The third and fourth pivot points C and D are preferably cantilever mounted pin joints that position one member directly beside the receiving member. In the present joint, link arm 52 is attached to the outward face of both post 40 and upper arm 48. Cantilever joints can be made from a sleeve bearing or other suitable pin joint that allows rotation of the connecting members about the connection point.

When boom arm 10 is used together with a second boom arm 10*a* as shown in FIGS. 5 and 6, cross members 90 and 92 connect the boom arm 10 to boom arm 10*a* at upper arms 48. Cross members 90 and 92 are inserted through holes cut out of upper arms 48 and welded in place to prevent sliding.

As best shown in FIG. 5, boom arm 10 may include a self leveling linkage assembly 105 to provide self leveling of bucket 14 and prevent bucket 14 from unintentionally tipping over and spilling materials. In practice, self leveling linkage assembly 105 removes one aspect of control from the operator, making usage of boom arm 10 more straightforward. Self leveling linkage assembly 105 consists of a self leveling link 110, a bell crank 114 and a bucket tilt cylinder 118.

Self leveling link 110 is a solid, rectangular cross section member. The proximal end of self leveling link 110 is attached to post 40 at a connection point F. Self leveling link 110 has a curved portion 122 at its proximal end to allow attachment to post 40 without contacting link arm 52. Connection point F is a standard straddle mounted pin joint and is located above lower arm axis L.

Bell crank 114 is a triangular, ternary link formed from two spaced and opposing plates 124 and 126. A first pin joint 127 of bell crank 114 is attached at pivot point D so that it may pivot relative to both upper arm 48 and link arm 52. The spaced portion of bell crank 114 receives the proximal end of upper arm 48 in a straddle mount fashion. It is preferable to locate first pin joint 127 in this location so that error in the tilt of bucket 14 may be reduced given a properly size bell crank. The distal end of self leveling link 110 is straddle mounted to a second pin joint 128 of bell crank 114 at a first non-rotating pin 128*a*. A third pin joint 129 of bell crank 114 is connected to the proximal end of bucket tilt cylinder 118 at a second non-rotating pin 129*a*. In the preferred embodiment, pin joints 128 and 129 are located above pin joint 127.

Bucket tilt cylinder 118 is connected to the hydraulic system similarly to hydraulic cylinder 56. The distal end of bucket tilt cylinder 118 is connected to the bucket at coupling point 130. Optionally, bucket tilt cylinder 118 can be replaced with a solid member if bucket 14 does not need tilt control or if another actuation mechanism is available.

Optionally, a control link 140 connects the distal end of bucket tilt cylinder 118 and the distal end of upper arm 48 at two non-rotating pin joints 142 and 144. Control link 140 provides additional structural integrity to the bucket tilt linkage assembly.

Non-rotating pins 124, 126, 142 and 144 are similar in construction to sleeve bearings, however, one end of the shaft has an end cap with a radially extending hook that curves back down along the axis of the shaft. When the non-rotating pin is inserted through the pin join, the hook slides into a slot cut out of the outer members. The hook prevents the pin from rotating in the joint. This reduces frictional wear on the sleeve and shaft.

In operation, the self leveling link 110 rotates about connection point F in the same angular direction as lower arm 44. This causes bell crank 114 to pivot in the opposite angular direction about pivot point D. The pivoting motion forces bucket tilt cylinder 118 to rotate bucket 14 in a downward angular direction relative to upper arm 48. The relative downward rotation is meant to counter act the upward rotation induced by the rotation of the upper arm. In practice, the geometry of bell crank 114 is selected so that there is no substantial absolute rotation of bucket 14 with respect to the ground, such that bucket 14 is maintained in a substantially level state during raising and lowering of boom arm 10.

Figure 7:
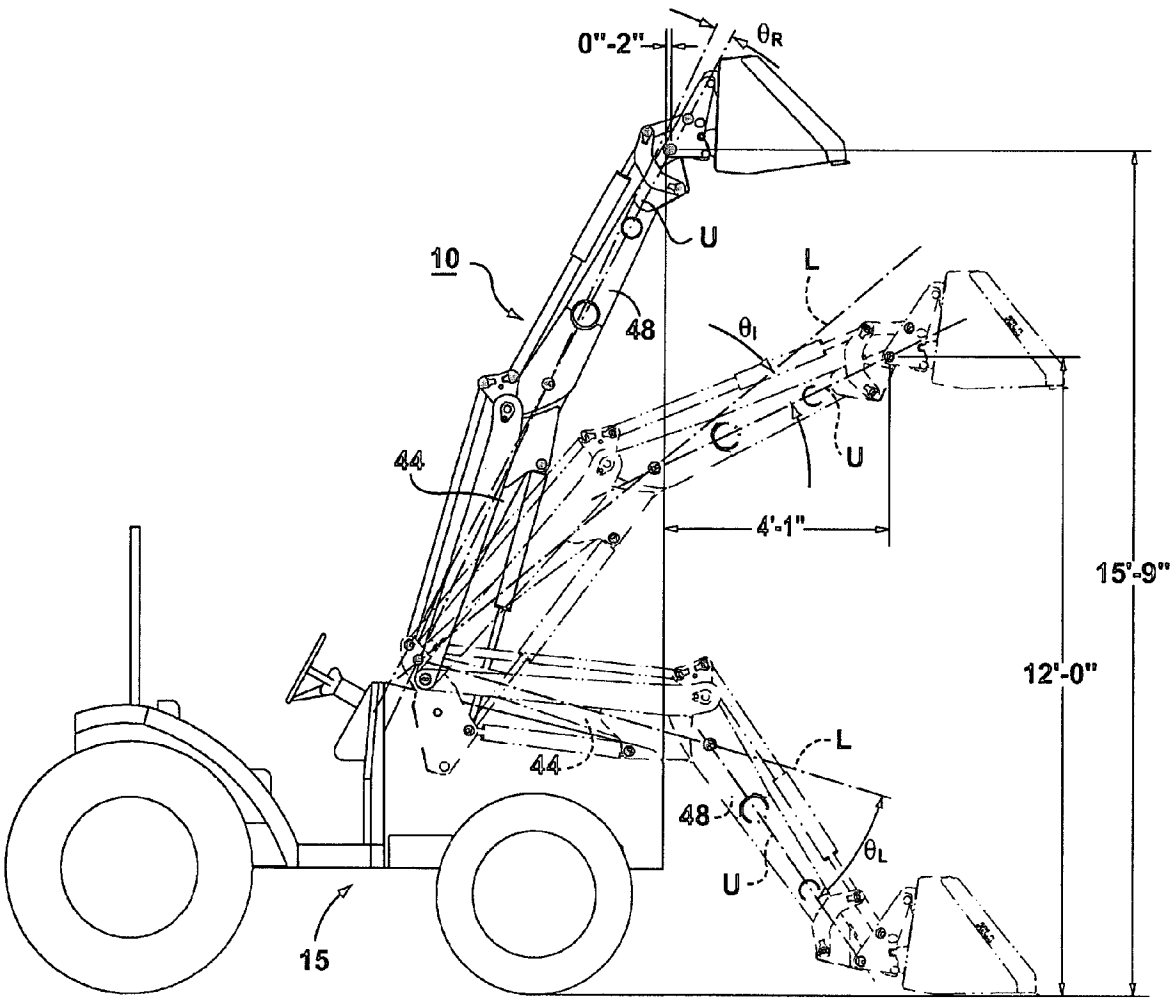
FIG. 7 is a side elevational view of the subject boom arm attached to a tractor with the boom arm shown in solid lines in a raised position and shown in broken lines in an intermediate position and in a lowered position.

FIG. 7 depicts loader boom arm 10 in three positions, a lowered position shown in broken lines in which upper arm axis U extends at an angle $\theta_L$ to lower arm axis L, a raised position shown in solid lines in which upper arm axis U extends at an angle $\theta_R$ to lower arm axis L, and an intermediate position shown in broken lines in which upper arm axis U extends at an angle $\theta_I$ to the lower axis L. In its raised position, loader boom arm 10 extends 15'9" above the ground, and in its intermediate position, loader boom arm 10 extends 12'0" above the ground and 4'1" in front of tractor 15.

Figure 8:
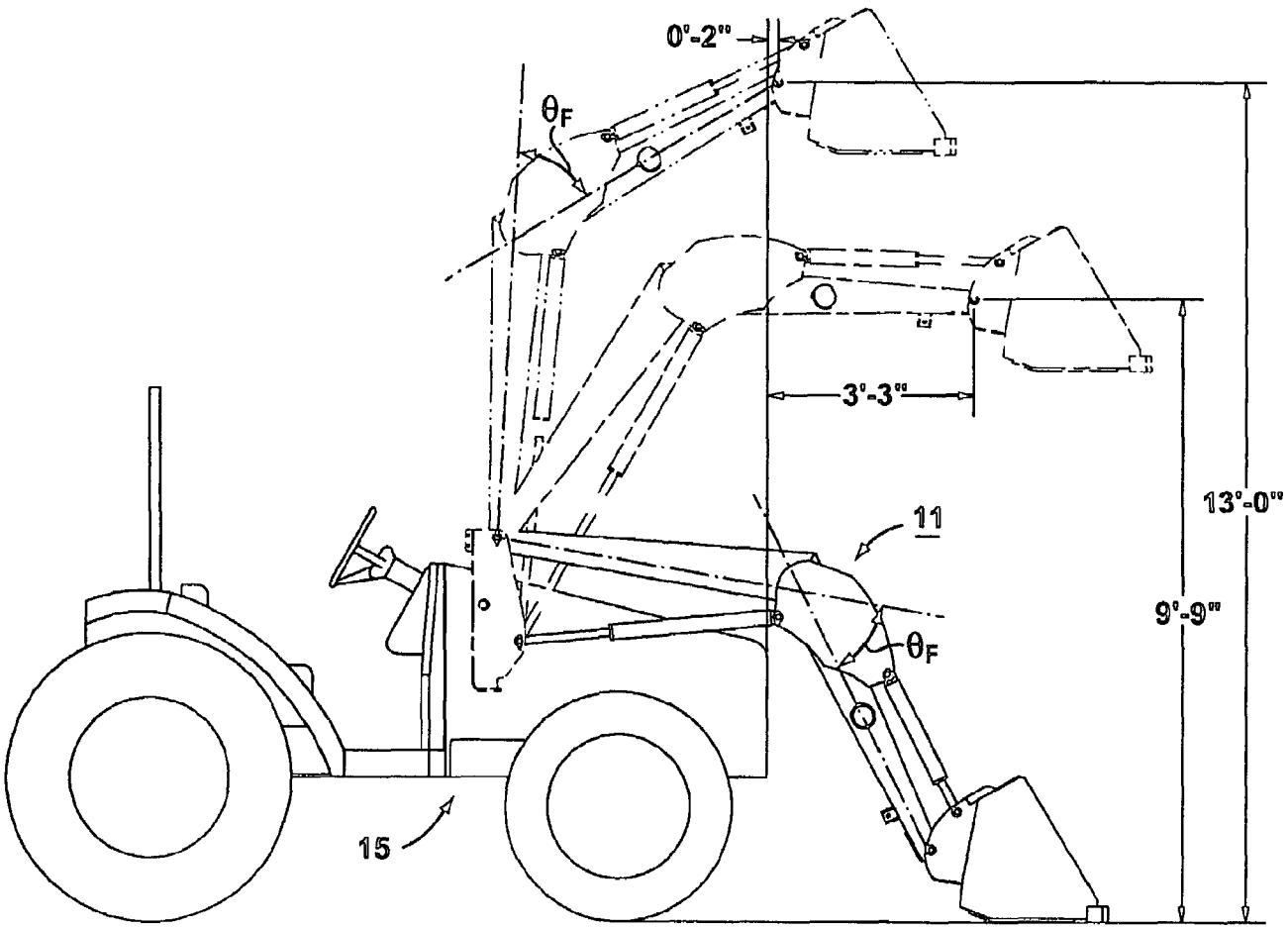
FIG. 8 (Prior Art)
FIG. 8 is a side elevational view of a prior art boom arm attached to a tractor with the boom arm shown in solid lines in a lowered position and shown in broken lines in a raised position and an intermediate position.

FIG. 8 depicts a prior art loader boom arm 11 in three positions, a lowered position shown in sold lines, a raised position shown in dotted lines, and an intermediate position shown in dashed lines. Prior art boom arm 11 comprises an upper arm that is rigidly attached to a lower arm at a fixed angle $\theta_F$. In its raised position, boom arm 11 extends 13'0" above the ground. In its intermediate position, boom arm 11 extends 9'9" above the ground and 3'3" in front of tractor 15.

Comparing loader boom arm 10 shown in FIG. 7 with prior art loader boom arm 11 shown in FIG. 8, loader boom arm 10 provides a 2'9" increase in its height in its raised position and a 8" increase in forward reach in its intermediate position, compared to prior art loader boom arm 11 shown in FIG. 8. Thus it can be seen that the relative movement between upper arm 48 and lower arm 44 as boom arm 10 is raised or lowered provides additional elevation and forward extension of bucket 14, as compared to that of conventional two piece boom arm 11.

Figure 9:
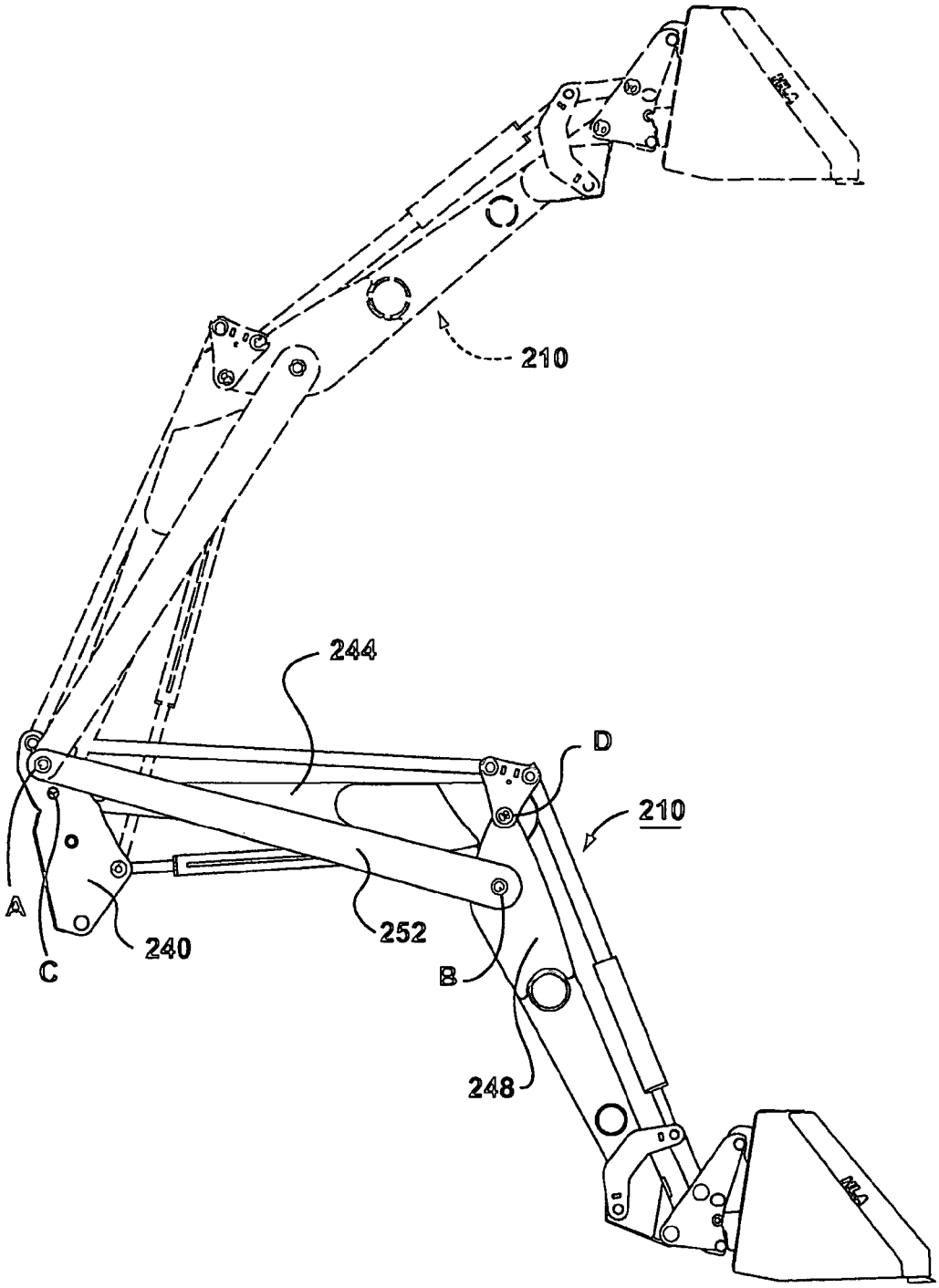
FIG. 9 is a side elevational view of a boom arm made in accordance with an alternative embodiment of the invention, shown in solid lines in a lowered position and in broken lines in a raised position.

Referring now to FIG. 9, illustrated therein is a reverse cross link boom arm 210 made in accordance with an alternative embodiment of the invention. Boom arm 210 comprises post 240, lower arm 244, upper arm 248 and link arm 252. Boom arm 210 is shown in solid lines in its lowered position and in broken lines in its raised position. Boom arm 210 is generally similar to boom arm 10 of the preferred embodiment, except that the positions of the lower arm and the link arm are reversed. Thus, lower arm 244 is pivotally attached to post 240 at pivot point C, instead of pivot point A as is the case of boom arm 10. Similarly, link arm 252 is pivotally attached to post 240 at pivot point A (instead of pivot point C) and to upper arm 248 at pivot point B (instead of pivot point D). In this configuration, link arm 252 pushes up (instead of pulling down) on upper arm 248 as lower arm 244 is raised, thereby causing upper arm 248 to rotate further in the direction of rotation than lower arm 244. In this configuration, upper arm 248 functions as a class 3 lever, having a fulcrum at pivot point D and a lever or effort arm extending between pivot point D and pivot point B.

While the preferred embodiment of the present invention utilizes a four bar linkage having a particular geometry, it should be understood that modifications could be made to the geometry of the linkage without affecting the operation of the invention.

While the boom arm is shown as being suitable for mounting on a tractor, it should be understood that the boom arm could be modified for use on a backhoe or other material handling vehicle, in which case the post could be modified to fit the frames of such vehicle. Also, while the boom arm is shown adapted for use in pairs to manipulate large buckets, the boom arm could be modified to be used by itself to manipulate smaller buckets on smaller vehicles.

Referring now to FIGS. 10 to 14, illustrated therein is a loader boom arm 310 made in accordance with a further alternative embodiment of the present invention, having a low profile self leveling linkage assembly. Loader boom arm 310 comprises post 340, lower arm 344, upper arm 348, link arm 352, and self leveling linkage assembly 360. Post 340, lower arm 344, upper arm 348, and link arm 352 of boom arm 310 are generally similar in structure to corresponding components of boom arm 10, namely post 40, lower arm 44, upper arm 48 and link arm 52, respectively.

Low profile self leveling linkage 360 comprises a control arm 362, a rotator link 364 and an output arm 366, which interact together to maintain the levelness of bucket 14 during raising and lowering of boom arm 310. Control arm 362 is pivotally connected to lower arm 344. Rotator link 364 is pivotally connected to control arm 362 and pivotally connected to upper arm 348. Output arm 366 is pivotally connected to rotator link 364 and has a free end attachable to bucket 14. The size and connection locations of control arm 362, rotator link 364 and output arm 366 are selected so as to rotate bucket 14 relative to upper arm 348 such that the absolute rotation of bucket 14 relative to a ground reference is negligible.

Given a bucket with no self leveling linkage assembly, the bucket will rotate a specific amount due to the rotation of lower arm 344 relative to post 340 and due to the rotation of upper arm 348 relative to lower arm 340. With implementation of self leveling linkage 360, output arm 366 rotates bucket 14 an equal amount in the opposite direction, thus maintaining the levelness of bucket 14. To achieve the required opposite rotation, output arm 366 traverses a specific distance toward bucket 14. Traversing of output arm 366 is related to the degree of rotation experienced by rotator link 364 and the motion of control arm 362, both of which are related to the rotation of upper arm 348 relative to lower arm 344.

Control arm 362 is connected to plates 344*a*, 344*b* of lower arm 344 at point M, which is below a lower arm axis L' and an upper arm axis U'. Point M is relatively close to upper arm 348. Control arm 362 is preferably made as short as possible and connected to rotator link 364 at point N which is below lower arm axis L' and upper arm axis U'. The location of point M and N and the size of control arm 362 should be made such that neither control arm 362 nor rotator link 364 interfere with the rotation of lower arm 344 or upper arm 348.

Rotator link 364 is also pivotally connected to upper arm 348 at a leveling fulcrum O. The distance between O and N, herein after referred to as leveling lever arm 368, should be kept to a minimum. If control arm 362 and leveling lever arm 368 are kept short, a smaller self leveling linkage assembly can be achieved. Although leveling fulcrum O is shown below upper arm axis L', it is feasible to place the connection point above the axis.

Figure 10:
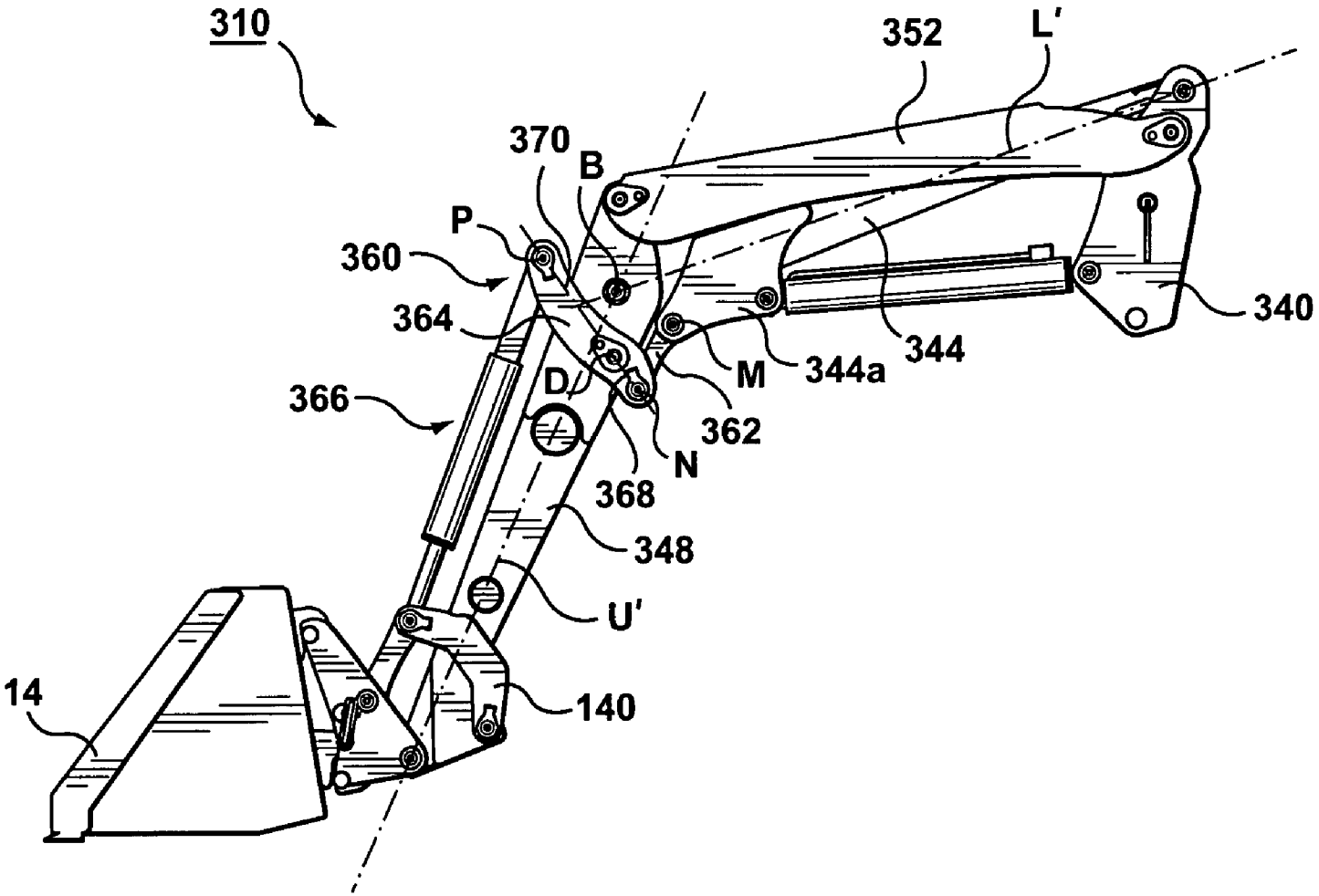
FIG. 10 is a side view of a loader boom arm with a low profile self leveling linkage assembly made in accordance with a further alternative embodiment of the invention, shown in a lowered position.
Figure 12:
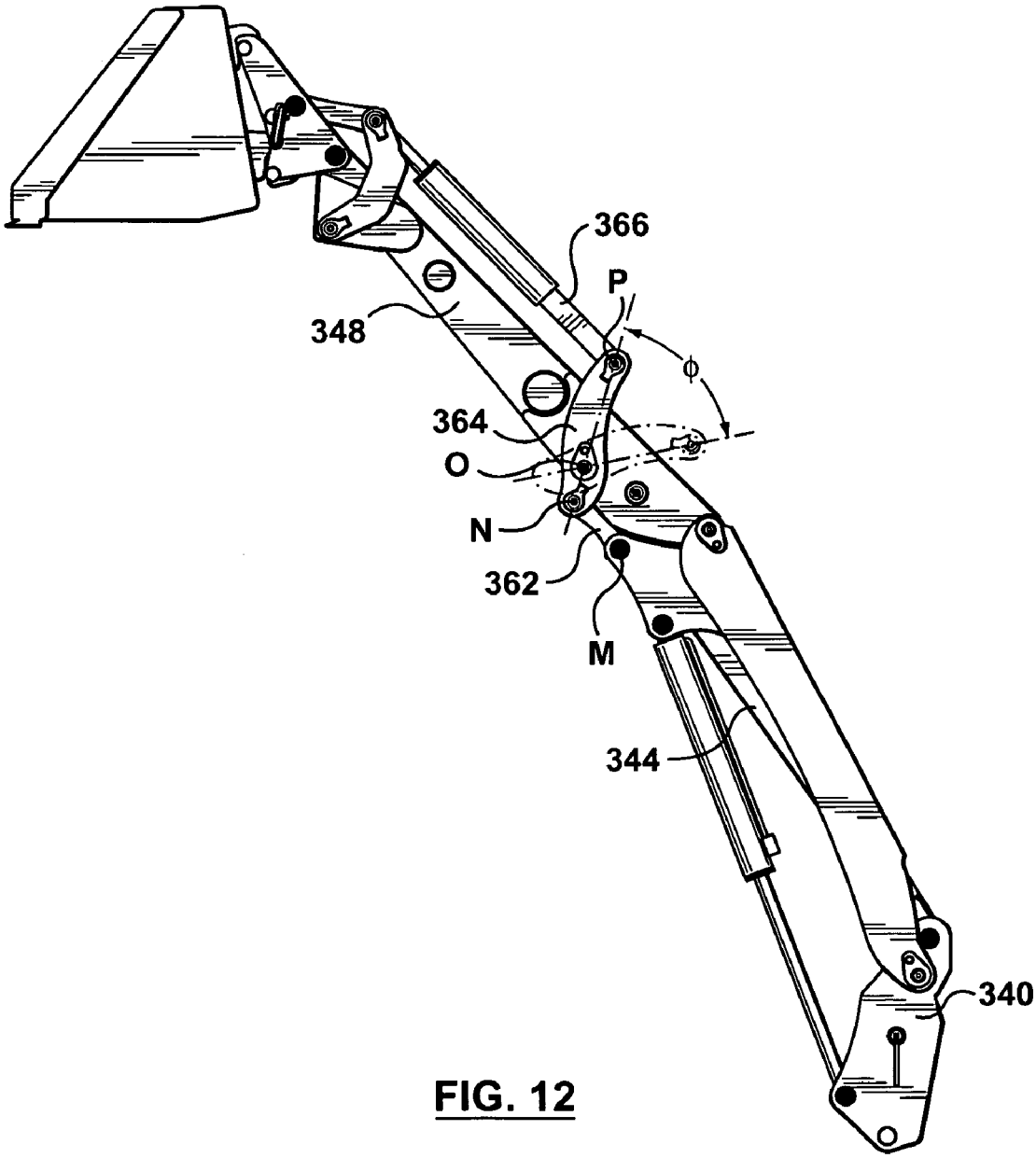
FIG. 12 is a side view of the loader boom arm with the low profile self leveling linkage assembly, shown in a completely raised position.

Referring now to FIGS. 10 and 12, given the connection points M, N and O, rotator link 364 will rotate an angular distance, "ϕ" due to the mechanism formed by the links between points M, N, O and B. Point P, located at the connection of rotator link 264 and output arm 366, can then be determined by knowing how much output arm 366 needs to traverse so that bucket 14 remains level. Therefore, the distance between O and P, hereinafter referred to as the leveling resistance arm 370, must be sized such that the arc swept out by point P has a length equivalent to the travel required by output arm 366. It is noted that the exact location of point P may need to be adjusted to minimize the bucket's variance from level during the entire raising and lowering process of boom arm 310. In general, point P is located above upper arm axis U'.

As illustrated, rotator link 364 is s-shaped, although points N, O and P are co-linear. An s-shape is used primarily for aesthetics, however, some strength is achieved via thicker cross-sections along the curved portions of rotator link 364.

In the present embodiment, output arm 366 comprises a hydraulic cylinder, which allows independent tilt control of bucket 14 through linear actuation. Typically, the hydraulic cylinder is activated after boom arm 310 has been raised or lowered to a desired height. Afterwards, the hydraulic cylinder can tilt bucket 14 to a desired angle from the level position.

Figure 13:
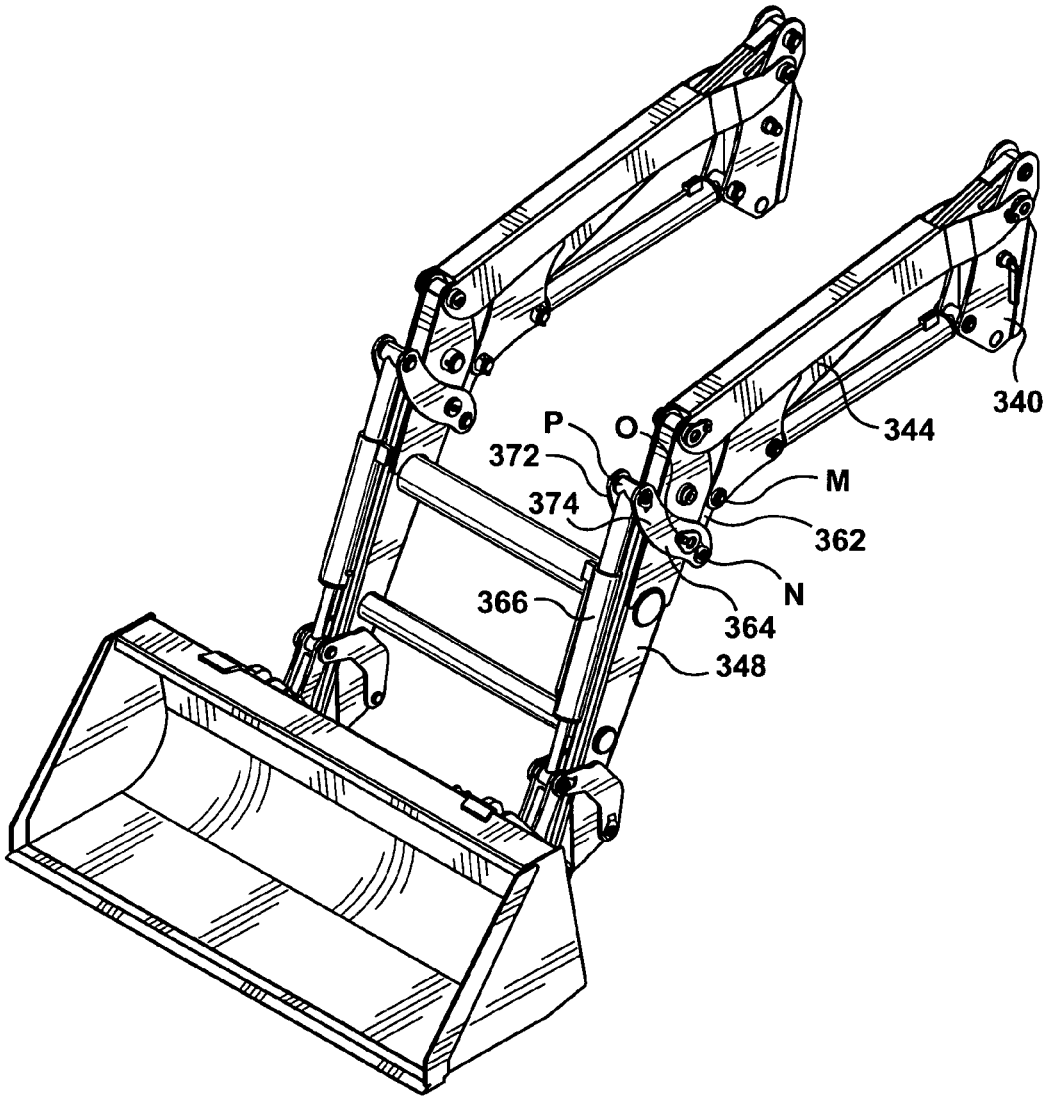
FIG. 13 is an front perspective view of the loader boom arm with the low profile self leveling linkage assembly, shown in the lowered position.
Figure 14:
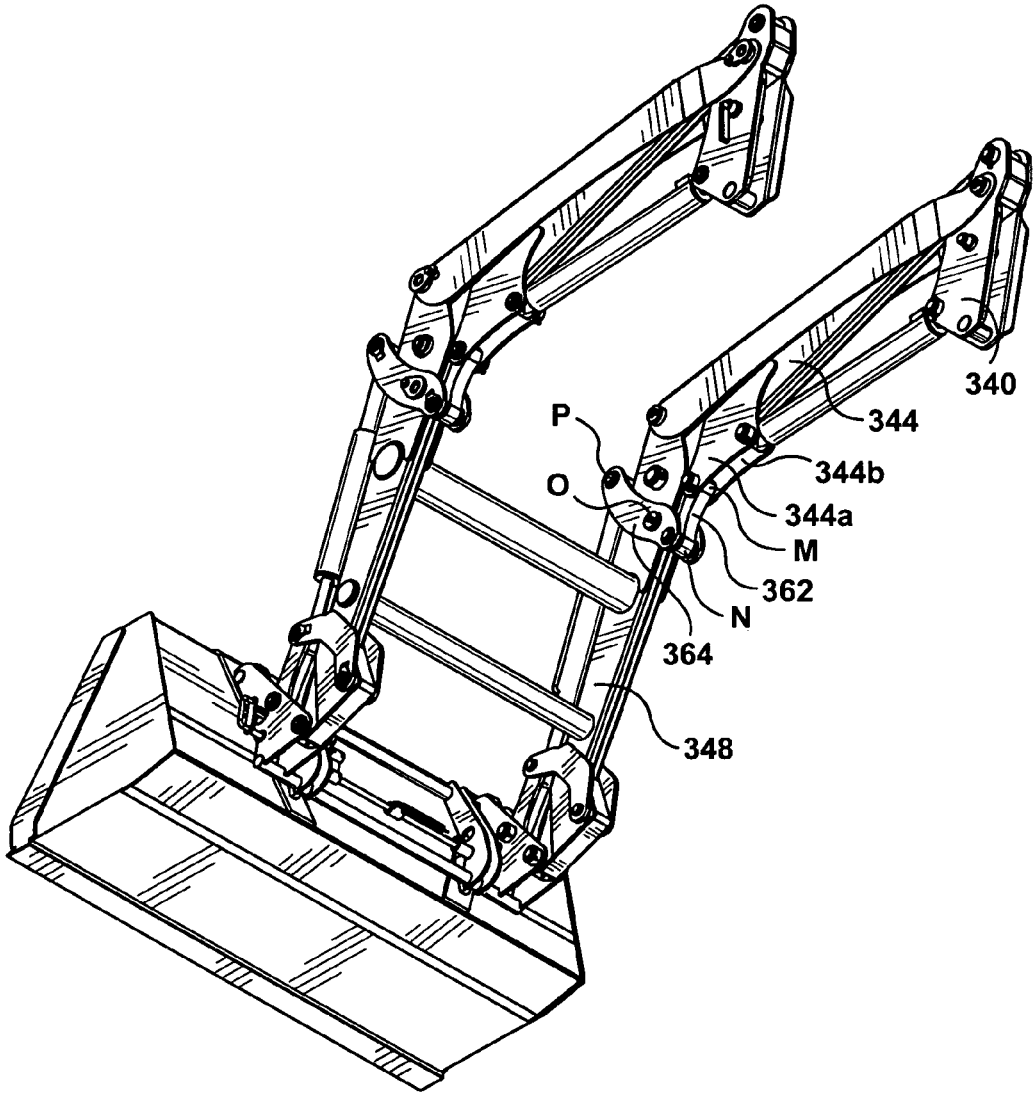
FIG. 14 is a rear perspective view of the loader boom arm with the low profile self leveling linkage assembly, shown in the lowered position.

Referring to FIGS. 13 and 14, the joints shown at points M, N, O, and P are straddle mounted pin joints that allow angular rotation of members 362, 364 and 366 about their respective connection points. In particular, leveling fulcrum O is a sleeve bearing that holds upper arm 348 between two plates 372, 374 that form rotator link 364. There are also two end caps on either end of the sleeve bearing that hold the entire joint together. The joints shown at points M and P are non-rotating pin joints similar to joints 128 and 129. Point M is another sleeve bearing, however, with slightly different end caps.

Figure 11:
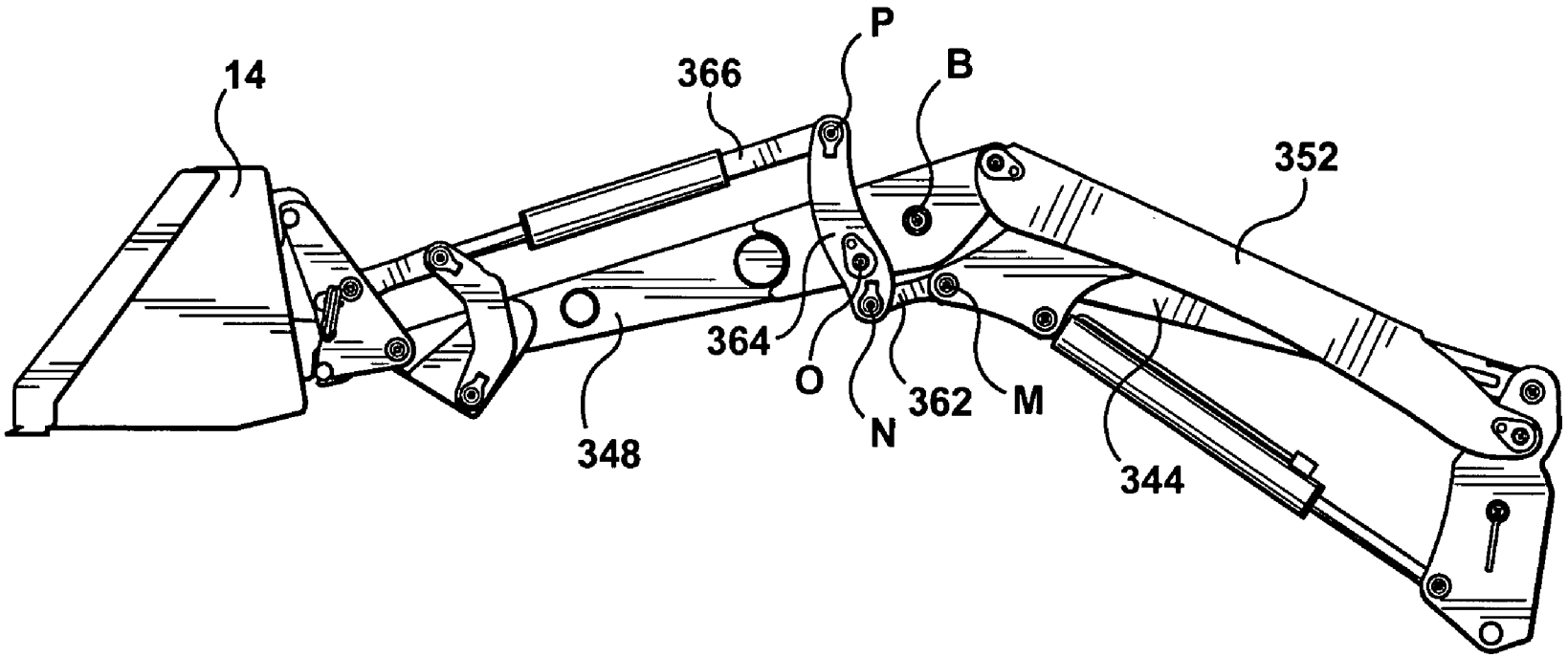
FIG. 11 is a side view of the loader boom arm with the low profile self leveling linkage assembly, shown in a partially raised position.

FIG. 10 depicts boom arm 310 in its lowered position wherein bucket 14 is in a first orientation relative to post 340, the orientation of which will be referred to as the level state. FIG. 11 depicts boom arm 310 in a partially raised position, wherein bucket 14 remains in a substantially level orientation. FIG. 12 depicts boom arm 310 in a fully raised position, wherein bucket 14 still remains in a substantially level orientation. As shown in FIGS. 10 to 12, self leveling linkage assembly 360 maintains a substantially level bucket during raising and lowering of boom arm 310.

Self leveling linkage assembly 360 is designed to provide the operator with a better view, by reducing the number of obstacles present in front of the operator. In comparison to self leveling linkage assembly 105, shown in FIG. 2, self leveling linkage assembly 360 has a lower profile. This improves an operator's field of view in front of boom arm 310 and allows for more precise actuation of boom arm 310. In addition, self leveling linkage assembly 360 utilizes fewer components than self leveling linkage assembly 105, which reduces manufacturing costs.

Although the self leveling linkage assembly of the present invention has been shown with a particular geometry, other geometries may be utilized. For instance, in an alternative embodiment, control arm 362 could be extended and output arm 360 could be proportionally shortened while maintaining nearly identical operation. It is also possible to increase/decrease the length of leveling lever arm 368 with a proportional increase/decrease in leveling resistance arm 370. In another alternative embodiment, leveling lever arm 368 is located on the same side as leveling resistance arm, both of which would be above the upper arm axis U'. In this case, point P would typically be located between point O and point M and control arm 362 would cross over upper arm 348. However, this embodiment increases the number of obstacles in the operator's field of view. These alternative embodiments represent only a few of the possible geometries that achieve the desired function of the self leveling linkage assembly of the present invention.

It should therefore be apparent to one skilled in the art that various modifications can be made to the embodiments disclosed herein, without departing from the present invention, the scope of which is defined in the appended claims.

The invention claimed is:

1. A loader boom arm comprising:

a) a post rigidly attachable to a vehicle;

b) a lower arm extending along a lower arm axis, the lower arm having a proximal end and a distal end, the proximal end being pivotally connected to the post at a first pivot point;

c) a pivoting mechanism coupled to the post and the lower arm for pivoting the lower arm about the first pivot point in an angular direction of rotation wherein the pivoting mechanism comprises a hydraulic cylinder extending from the post and attached to the lower arm at a point near the distal end thereof;

d) an upper arm extending along an upper arm axis, the upper arm axis being oriented at an angle to the lower arm axis, the upper arm having a proximal end pivotally connected to the distal end of the lower arm at a second pivot point, and a distal end shaped for receiving a work implement; and e) a link arm pivotally connected to the post and to the upper arm, the link arm being configured and located for rotating the upper arm about the second pivot point as the lower arm is pivoted by the pivoting mechanism, such that the upper arm rotates further in the angular direction of rotation than the lower arm, thereby changing the angle between the lower arm axis and the upper arm axis, the link arm having a first end pivotally coupled to the post at a third pivot point located below the lower arm axis and a second end pivotally coupled to the upper arm at a fourth pivot point located above the lower arm axis when the lower arm is in a lowered position.

2. A loader boom arm, comprising:

a post rigidly attachable to a vehicle;

(b) a lower arm pivotally connected to the post at a first pivot point;

(c) a pivoting mechanism coupled to the post and the lower arm for pivoting the lower arm about the first pivot point in an annular direction of rotation;

(d) an upper arm pivotally connected to the lower arm at a second pivot point, the upper arm having a free end shaped for receiving a work implement;

(e) a link arm pivotally connected to the post and to the upper arm, the link arm being configured and located for pivoting the upper arm about the second pivot point in the annular direction of rotation as the lower arm is pivoted about the first pivot point by the pivoting mechanism; and (f) a self leveling linkage assembly for maintaining the levelness of the work implement during raising and lowering of the boom arm, the self leveling linkage assembly comprising:

(i) a control arm pivotally connected to the lower arm;

(ii) a rotator link pivotally connected to the control arm and pivotally connected to the upper arm at a leveling fulcrum; and (iii) an output arm pivotally connected to the rotator link and pivotally connectable to the work implement.

3. The boom arm defined in claim 2, wherein the output arm comprises a linear actuator.

4. The boom arm defined in claim 2, wherein the rotator link is configured to function as a lever that pivots about the leveling fulcrum, wherein the lever comprises a leveling lever arm portion and a leveling resistance arm portion, the leveling lever arm portion being coupled to the control arm and the leveling resistance arm portion being coupled to the output arm.

5. The boom arm defined in claim 2, wherein upward pivoting of the upper arm relative to the lower arm causes the control arm portion to pull on the leveling lever arm thereby pivoting the rotator link about the leveling fulcrum and causing the leveling resistance arm portion to push the output control arm toward the free end of the upper arm.

6. The boom arm defined in claim 2, wherein the self leveling linkage assembly rotates the work implement an angle equivalent to the rotation of the upper arm axis relative to the post plus the rotation of the lower arm axis relative to the lower arm.

7. A loader boom arm comprising:

(a) a post rigidly attachable to a vehicle;

(b) a lower arm extending along a lower arm axis, the lower arm having a proximal end and a distal end, the proximal end being pivotally connected to the post at a first pivot point;

(c) a pivoting mechanism coupled to the post and the lower arm for pivoting the lower arm about the first pivot point in an angular direction of rotation;

(d) an upper arm extending along an upper arm axis, the upper arm axis being oriented at an angle to the lower arm axis, the upper arm having a proximal end pivotally connected to the distal end of the lower arm at a second pivot point, and a distal end shaped for receiving a work implement;

(e) a link arm pivotally connected to the post and to the upper arm, the link arm being configured and located for rotating the upper arm about the second pivot point as the lower arm is pivoted by the pivoting mechanism, such that the upper arm rotates further in the angular direction of rotation than the lower arm, thereby changing the angle between the lower arm axis and the upper arm axis; and (f) further comprising a self leveling linkage assembly for maintaining the levelness of the work implement during raising and lowering of the boom arm, the self leveling linkage assembly comprising:

(i) a control arm pivotally connected to the lower arm, (ii) a rotator link pivotally connected to the control arm and pivotally connected to the upper arm at a leveling fulcrum, and (iii) an output arm pivotally connected to the rotator link and pivotally connectable to the work implement, (iv) wherein the rotator link functions as a lever, having a leveling lever arm portion between the leveling fulcrum and the control arm, and a leveling resistance arm portion between the leveling fulcrum and the output arm, such that as the lower arm pivots about the first pivot point and the upper arm pivots about the second pivot point, the control arm applies a force to the leveling lever arm portion to rotate the rotator link about the fulcrum, the leveling resistance arm portion concurrently applies a force to the output arm which is transmitted to the work implement such that the work implement rotates about the upper arm and remains substantially level during raising and lowering of the boom arm.

8. The boom arm defined in claim 4, wherein the leveling lever arm portion and the leveling resistance arm portion are located on opposite sides of the leveling fulcrum.

9. The boom arm defined in claim 1, wherein the fourth pivot point is offset from the upper arm axis.

10. The boom arm defined in claim 9, wherein the fourth pivot point is offset above the upper arm axis.

11. The boom arm defined in claim 1, wherein the link arm is configured so that the upper arm axis is oriented at a first angle to the lower arm axis when the upper arm is in a fully lowered position, the first angle being selected to provide wheel clearance between the lower arm and a front wheel on the vehicle, and the upper arm is oriented at a second angle to the lower arm axis when the upper arm is in a fully raised position, wherein the second angle is less than the first angle.

12. The boom arm defined in claim 11, wherein a second angle is selected so that when the boom arm is in a fully raised position, the lower arm and the upper arm are substantially co-linear.

13. The boom arm defined in claim 1, wherein the upper arm comprises a pair of spaced, parallel plates shaped to provide a pivot point for the link arm.

* * * * *